US010928780B2

(12) United States Patent
Loetscher

(10) Patent No.: US 10,928,780 B2
(45) Date of Patent: Feb. 23, 2021

(54) PUSH BUTTON DEVICE FOR TIMEPIECES

(71) Applicant: Omega SA, Biel/Bienne (CH)

(72) Inventor: Philippe Loetscher, Evilard (CH)

(73) Assignee: Omega SA, Biel/Bienne (CH)

( * ) Notice: Subject to any disclaimer, the term of this patent is extended or adjusted under 35 U.S.C. 154(b) by 309 days.

(21) Appl. No.: 16/103,334

(22) Filed: Aug. 14, 2018

(65) Prior Publication Data

US 2019/0072905 A1 Mar. 7, 2019

(30) Foreign Application Priority Data

Sep. 1, 2017 (EP) ..... 17189110

(51) Int. Cl.
*G04B 37/10* (2006.01)
*G04B 3/04* (2006.01)

(52) U.S. Cl.
CPC ..... *G04B 37/106* (2013.01); *G04B 3/048* (2013.01)

(58) Field of Classification Search
CPC .. G04B 37/106; G04B 3/048; G04B 37/0091; G04B 3/043; G04B 3/045; G04B 19/18; G04B 37/0008; G04B 47/066; G04B 19/286; G04F 7/0866; G04C 3/001
USPC ..... 368/290
See application file for complete search history.

(56) References Cited

U.S. PATENT DOCUMENTS 8,408,785 B2 * 4/2013 Hiranuma ..... G04B 37/08 368/291
8,419,269 B2 * 4/2013 Hiranuma ..... G04B 37/02 368/291
8,608,372 B2 * 12/2013 Koshoji ..... G04B 37/106 368/308
9,336,967 B2 * 5/2016 Sakurazawa ..... H01H 13/06
10,725,429 B2 * 7/2020 Loetscher ..... G04B 3/045

FOREIGN PATENT DOCUMENTS

CH 707 158 A2 5/2014
CH 708 126 A2 12/2014

OTHER PUBLICATIONS

European Search Report dated Mar. 5, 2018 in European Application 17189110.4, filed on Sep. 1, 2017 (with English Translation of Categories of cited documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A push button device including a device for adjusting the angular orientation of the push button head with respect to the watch case, wherein the angular orientation adjustment device includes a friction ring disposed concentrically around the central shaft inside the tube, the friction ring rotates integrally with the central shaft and is free in translation with respect to the central shaft, the friction ring includes an external friction surface in friction contact with an internal wall of the tube, and wherein the central shaft includes a device for actuating the latter in rotation, making it possible to pivot the push button against the frictional forces generated by the friction ring, in order to adjust the angular orientation of the push button head.

18 Claims, 1 Drawing Sheet

PUSH BUTTON DEVICE FOR TIMEPIECES

BACKGROUND

This application claims priority from European patent application No. 17189110.4 filed on Sep. 1, 2017, the entire disclosure of which is hereby incorporated herein by reference.

The present invention concerns a push button device for timepieces, and more particularly a device of this type wherein the push button head includes a motif or a logo on its end face and wherein the motif can be oriented as desired.

BRIEF SUMMARY

A push button device for timepieces typically includes a cylindrical tube, through and inside which is longitudinally disposed a push button provided with a head having a lower face that abuts against a first shoulder made in the tube when manual pressure is applied to the head and with a shaft that terminates at its end in a stop member, typically a screw, limiting the axial clearance of the shaft in the tube. A sealing gasket generally surrounds the shaft and a helical return spring is wound around the shaft to return the push button to a determined position.

Push buttons made in accordance with the above description are well known in the state of the art. They are fitted, for example, to chronographs or wristwatches for correcting the date, for example. They are called "push buttons" when they protrude from the case middle and can correct a function when pressed with a finger. When the pressure ceases, the push buttons return to their initial position. They are usually called "correctors" when they are embedded in the case middle.

The manufacture and assembly of these push buttons, which are screwed or pressed onto watch cases, are well known. However, methods for assembling such push button devices are ill suited to these push buttons when the push button bears an inscription or a motif, for example a logo, a trademark or similar sign, on its head end face. Indeed, known assembly methods do not generally allow the push button head to be brought into a determined precise angular orientation with respect to the case when the push button device is assembled by screwing or pressing the tube into the watch case. This therefore detracts from the aesthetics of the watch when an inscription is affixed to the end face of the push button head. This situation is evidently unacceptable when these push button devices are fitted to high quality and luxury products.

It is an object of the present invention to overcome the drawbacks of the aforementioned prior art by providing a push button device of simple and economical design, wherein the push button head includes on its end face a motif, such as a logo or a trademark, and wherein the position of the logo or the trademark affixed to said head end face can easily be adjusted into a precise determined angular position or orientation.

To this end, the invention concerns a push button device for timepieces, comprising:

a tube of generally cylindrical shape, intended to be assembled to a watch case, a push button provided, at a proximal end, with a head to allow a user to actuate the push button, said head being integral with a central shaft to ensure, at a distal end, the connection between the interior and exterior of the timepiece, said push button being engaged and axially slidably mounted in said tube, the front face of said head including a logo or a trademark, a return spring surrounding said shaft and inserted between an internal shoulder of the tube and the push button head, to generate an axial force, at least one sealing gasket surrounding said central shaft to ensure the seal between the central shaft and an internal wall of the tube, and a stop member for retaining said push button in said tube against the push force of the return spring, said device being characterized in that the device further includes:

a device for adjusting the angular orientation of the head with respect to the watch case, said angular orientation adjustment device including a friction ring disposed concentrically around the central shaft inside the tube, in that the friction ring rotates integrally with the central shaft and is free in translation with respect to the central shaft, in that the friction ring includes an external friction surface in friction contact with an internal wall of the tube, and in that the central shaft includes means for actuating the latter in rotation, making it possible to pivot the push button against the frictional forces generated by the friction ring in order to adjust the angular orientation of the head.

According to other advantageous aspects of the invention:

- the actuating means includes a slot arranged at the distal end of the central shaft.
- the actuating means may be a nut screwed onto the distal end of the central shaft, said nut also forming the stop member, and in that case the friction torque generated by the friction ring inside the tube is preferably greater than the screw torque of the nut on the central shaft.
- the friction ring includes an opening of polygonal shape and the central shaft has a polygonal cross-section, complementary to said opening, to make the central shaft integral in rotation with the ring.
- the tube has a first inner diameter defining a first housing, extended by a second diameter which is smaller than the first diameter and defines a shoulder and a second housing.
- the head is disposed inside the first housing and the friction ring is disposed inside the second housing, the central shaft extends into the first and second housings and projects via its distal end out of the second housing, and preferably, the shoulder receives, in its central portion, a washer surrounding said central shaft, the return spring extends between the head and said shoulder, and said at least one sealing gasket extends between the washer and the friction ring; and advantageously, the device includes two sealing gaskets surrounding the central shaft and between which is inserted a ring forming a spacer.
- the stop member is arranged at the distal end of the central shaft protruding out of the second housing, and preferably the stop member is formed of an elastic ring arranged in an annular groove of the distal end of the central shaft.
- the actuating means are arranged in the distal portion of the central shaft.

The invention also concerns a watch case including a push button device as described above.

BRIEF DESCRIPTION OF THE DRAWINGS

Other features and advantages of the present invention will appear more clearly from the following detailed description of a preferred embodiment, given by way of non-limiting example, with reference to the annexed drawings, in which.

DETAILED DESCRIPTION

Figure 1:
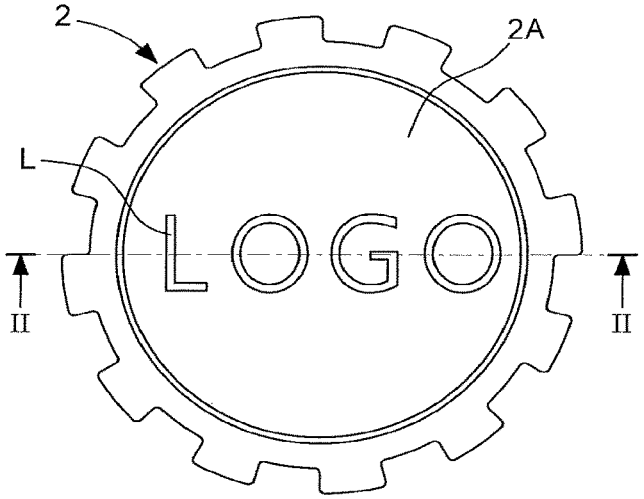
FIG. 1 shows a top view of a push button device with an orientable push button head, provided with a logo on the external face of the push button head according to the invention.
Figure 2:
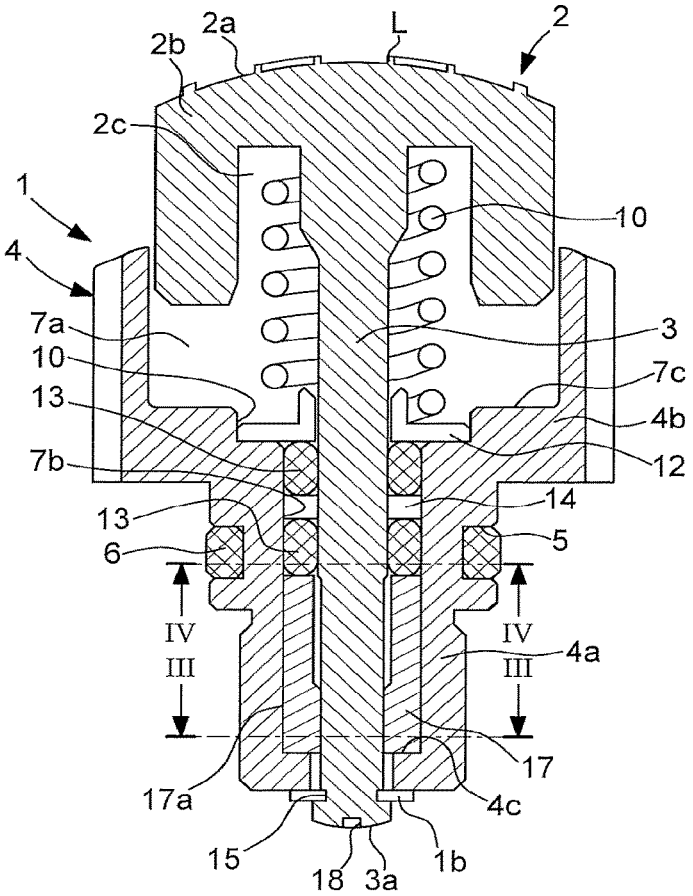
FIG. 2 shows a cross-sectional view of the push button device with an orientable push button head according to the invention along the line II-II of FIG. 1.

FIGS. 1 and 2 show a push button device 1 including an orientable push button head 2*a* and intended to be mounted by being pressed or screwed into the side wall of a watch case middle (not represented).

In FIG. 1, which is a top view of push button device 1, the inscription 'LOGO' can be seen, arranged on the external face 2*a* of head 2*b* of push button 2. Push button device 1 includes orientation adjustment means which will be described below with reference to FIGS. 2 to 4. For aesthetic reasons, the inscription 'LOGO' L is adjusted in a perfectly horizontal position, preferably corresponding to the plane of the middle part of the watch in which push button device 1 is mounted.

Push button device 1 includes a push button 3 which is provided at a proximal end with a push button head 2*b* to allow a user to actuate the push button. Push button head 2*b* is integral with a central shaft 3 which ensures, at a distal end, the connection between the interior and the exterior of the watch case. Push button head 2 has a smooth circular recess 2*b* surrounding the proximal portion of central shaft 3.

Push button device 1 further includes a tube 4 of generally cylindrical shape intended to be assembled to a watch case. In the illustrated example, tube 4 is intended to be pressed, via its lower portion 4*a*, into an opening in the watch case middle. Tube 4 has an upper portion 4*b* of larger diameter than lower portion 4*a*. In the lower area of its upper portion, tube 4 has an annular groove 5, inside which is housed an O-ring joint 6 which seals the tube with respect to the case middle.

According to the embodiments of the invention, tube 4 can either terminate in an upper portion that protrudes from case middle 4 or be embedded in the case middle.

Tube 4 has a first inner diameter defining a first housing 7*a*, extended by a second inner diameter, which is smaller than the first diameter and defines a second housing 7*b* and an internal shoulder 7*c*. Push button head 2*b* is partially engaged in housing 7*a* in the rest position of the push button and can engage further until it abuts against shoulder 7*c* when the push button is actuated by the user's finger.

Central shaft 3 is arranged inside tube 4 so that it can slide along its longitudinal axis A and rotate freely inside tube 4.

It is also seen that push button device 1 further includes a helical return spring 10 which surrounds the proximal portion of shaft 3 and which is partially housed inside recess 2*c* and inside housing 7*a*. Spring 10 is intended to resist the axial push force of the user's finger on push button head 2*b*. Spring 10 is mounted compressed between the bottom of recess 2*c* and internal shoulder 7*c* of tube 4. In the illustrated example, internal shoulder 7*c* includes a central circular recess 11 that receives a washer 12 surrounding central shaft 3. Washer 12 also rests on a pair of sealing gaskets 13, between which is inserted a washer 14.

In the illustrated example, at its distal end, protruding from housing 7*b*, central shaft 3 has an annular groove 15 in which is arranged an elastic ring 16 which moves into abutment against the distal end of tube 4. Elastic ring 16 thus forms a stop member for push button 2 inside tube 4. It will be noted that the distal end of tube 4 ends in a third diameter, which is smaller than the second diameter and defines, on the one hand, a passage for the distal end of central shaft 3 and, on the other hand, a second internal shoulder 4*c*.

The push button device further includes a device for adjusting the angular orientation of push button head 2*b* with respect to the watch case. The adjustment device includes a friction ring 17 disposed concentrically around central shaft 3.

The friction ring is arranged between washer 14 and second shoulder 4*c* and, in the illustrated example, friction ring 17 is disposed more particularly between the lower annular gasket 13 and shoulder 4*c*. It is evident that, in a variant, friction ring 17 could be disposed between upper annular gasket 13 and washer 14. Friction ring 17 has a cylindrical external surface 17*a* whose diameter is an interference fit on the internal wall of housing 7*b* of tube 4, and therefore in friction contact with this wall.

Figure 3:
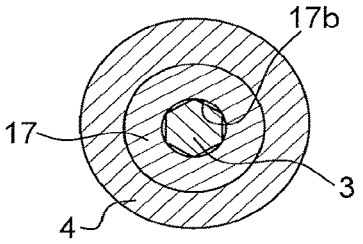
FIG. 3 shows a section of the push button device with an orientable push button head according to the invention along the line III-III of FIG. 2.
Figure 4:
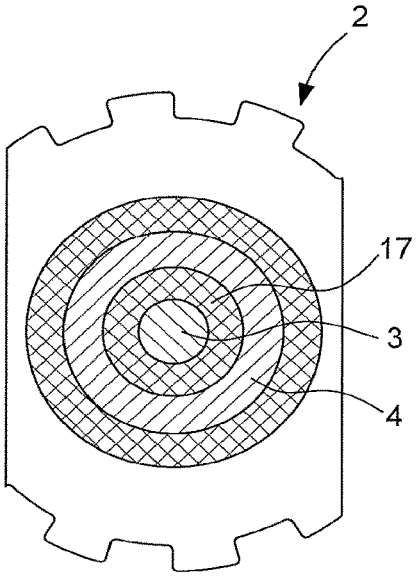
FIG. 4 shows a section of the push button device with an orientable push button head according to the invention along the line IV-IV of FIG. 2.

As seen in FIG. 3, friction ring 17 includes a central opening 17*b* of polygonal shape, in this case hexagonal, and central shaft 3 has a polygonal section complementary to opening 17*b* to make shaft 3 integral in rotation with ring 17 while allowing the shaft to move freely in translation in opening 17*b*.

It will be noted that central shaft 3 includes, in its distal face 4*a*, a slot 18 intended to cooperate with the end of a tool to actuate central shaft 3 in rotation against the frictional forces generated by the ring in order to adjust the angular orientation of push button head 2*b*. Slot 18 thus acts as a means of actuating push button 2 in rotation, which makes it possible to pivot the push button and thereby adjust the angular orientation of its head 2*b* into a determined angular position. It will be noted in this regard that the surface of the internal wall and/or cylindrical external surface 17*a* of the ring can be textured to adjust the appropriate friction torque.

However, in variant embodiments that are not represented, without departing from the scope of the invention, it would be possible to envisage providing, for example, a nut screwed onto the distal portion of central shaft 3 protruding out of tube 4 and acting as the stop member, with a slot arranged directly in the end face of the screw as the push button actuating means. In that case, the friction fit of friction ring 17 on the internal wall of housing 7*b* will be chosen so that the friction torque generated by the friction ring inside tube 4 is greater than the screw torque of the nut on central shaft 3. In this variant, the nut would have a dual function, i.e. of forming both the stop member for the push button and the means for actuating the latter in order to pivot and orient it angularly.

The method for assembling the push button device and for orientating the push button is as follows. The completely assembled push button device 1, with elastic ring 16 abutting against the distal end of tube 4, is pressed or screwed into an opening in the watch case middle. Once pressed or screwed in, with tube 4 thus immobilised in the case middle, central shaft 3 can be actuated in rotation by means of a tool inserted into slot 18 from inside the case middle and can drive the push button head in rotation. The push button head in turn thereby drives friction ring 13, via the polygonal connection between opening 17*a* and the cross-section of central shaft 2, into the desired angular orientation. Ring 17 rotates in tube 4 against the restraining friction torque present between external surface 17*a* of friction ring 17 and the internal wall of lower housing 7*b* of tube 4.

What is claimed is:

1. A push button device for timepieces, comprising:

a tube of generally cylindrical shape, configured to be assembled to a watch case, a push button provided at a proximal end with a head to allow a user to actuate the push button, said head being integral with a central shaft to ensure, at a distal end, the connection between the interior and exterior of the timepiece, said push button being engaged and axially slidably mounted in said tube, the front face of said head including a logo or a trademark, a return spring surrounding said shaft and inserted between an internal shoulder of the tube and the push button head, to generate an axial force, at least one sealing gasket surrounding said central shaft to ensure the seal between the central shaft and an internal wall of the tube, a stop member for retaining said push button in said tube against the push force of the return spring, a device for adjusting the angular orientation of the head with respect to the watch case, said angular orientation adjustment device including a friction ring disposed concentrically around, and in direct contact with, the central shaft inside the tube, wherein the friction ring rotates integrally with the central shaft and is free in translation with respect to the central shaft, wherein the friction ring includes an external friction surface in friction contact with an internal wall of the tube, and wherein the central shaft comprises means for actuating the latter in rotation making it possible to pivot the push button against the frictional forces generated by the friction ring in order to adjust the angular orientation of the head.

2. The push button device according to claim 1, wherein the actuating means includes a slot arranged at the distal portion of the central shaft.

3. The push button device according to claim 1, wherein the actuating means is a nut screwed onto the distal end of the central shaft, said nut also forming the stop member.

4. The push button device according to claim 3, wherein the friction torque generated by the friction ring inside the tube is greater than the screw torque of the nut on the shaft.

5. The push button device according to claim 1, wherein the friction ring includes an opening of polygonal shape and wherein the central shaft has a polygonal cross-section complementary to said opening in order to make the central shaft integral in rotation with the ring.

6. The push button device according to claim 1, wherein the tube has a first inner diameter defining a first housing extended by a second diameter which is smaller than the first diameter and defines a shoulder and a second housing.

7. The push button device according to claim 6, wherein the head is disposed inside the first housing and wherein the friction ring is disposed inside the second housing, the central shaft extending into the first and second housings and protruding via its distal end out of the second housing.

8. The push button device according to claim 6, wherein the shoulder receives, in its central portion, a washer surrounding said central shaft, wherein the return spring extends between the head and said shoulder, and wherein said at least one sealing gasket extends between the washer and the friction ring.

9. The push button device according to claim 8, wherein the device includes two sealing gaskets surrounding the central shaft and between which is inserted a ring forming a spacer.

10. The push button device according to claim 7, wherein the stop member is arranged at the distal end of the central shaft protruding out of the second housing.

11. The push button device according to claim 10, wherein the stop member is formed of an elastic ring arranged in an annular groove of the distal end of the central shaft.

12. The push button device according to claim 1, wherein the actuating means are arranged in the distal portion of the central shaft.

13. A watch case comprising a push button device, for timepieces, comprising:

a tube of generally cylindrical shape, intended to be assembled to a watch case, a push button provided at a proximal end with a head to allow a user to actuate the push button, said head being integral with a central shaft to ensure, at a distal end, the connection between the interior and exterior of the timepiece, said push button being engaged and axially slidably mounted in said tube, the front face of said head including a logo or a trademark, a return spring surrounding said shaft and inserted between an internal shoulder of the tube and the push button head, to generate an axial force, at least one sealing gasket surrounding said central shaft to ensure the seal between the central shaft and an internal wall of the tube, a stop member for retaining said push button in said tube against the push force of the return spring, a device for adjusting the angular orientation of the head with respect to the watch case, said angular orientation adjustment device including a friction ring disposed concentrically around, and in direct contact with, the central shaft inside the tube, wherein the friction ring rotates integrally with the central shaft and is free in translation with respect to the central shaft, wherein the friction ring includes an external friction surface in friction contact with an internal wall of the tube, and wherein the central shaft includes means for actuating the latter in rotation making it possible to pivot the push button against the frictional forces generated by the friction ring in order to adjust the angular orientation of the head.

14. The watch case according to claim 13, wherein the tube has a first inner diameter defining a first housing extended by a second diameter which is smaller than the first diameter and defines a shoulder and a second housing, and the friction ring is disposed in the second housing.

15. The watch case according to claim 13, wherein the tube has a first inner diameter defining a first housing extended by a second diameter which is smaller than the first diameter and defines a shoulder and a second housing, and the shoulder of the second housing is located at an opposite end of the second housing from the first housing and the friction ring abuts the shoulder.

16. The watch case according to claim 13, wherein the friction ring includes an opening of polygonal shape and wherein the central shaft has a polygonal cross-section complementary to said opening in order to make the central shaft integral in rotation with the ring.

17. The push button device according to claim 6, wherein the friction ring is disposed in the second housing.

18. The push button device according to claim 6, wherein the shoulder of the second housing is located at an opposite end of the second housing from the first housing and the friction ring abuts the shoulder.

* * * * *